United States Patent [19]

Previsani

[11] Patent Number: 4,588,458

[45] Date of Patent: May 13, 1986

[54] SINGLE PLY ROOFING BASE SHEET ADHERENCE METHOD

[75] Inventor: Mario Previsani, Vascigliano di Stroncone, Italy

[73] Assignee: U.S. Intec, Inc., Port Arthur, Tex.

[21] Appl. No.: 665,020

[22] Filed: Oct. 26, 1984

[51] Int. Cl.[4] ..... E04B 2/00

[52] U.S. Cl. ..... 156/71; 52/746; 156/82; 156/252; 156/309.6; 156/309.9; 156/313; 156/324.4; 156/337

[58] Field of Search ..... 156/324.4, 337, 71, 156/309.6, 252, 309.9, 82, 313; 52/746

[56] References Cited

U.S. PATENT DOCUMENTS

| | | | |
|---|---|---|---|
| 1,609,938 | 12/1926 | Forrest | 156/71 |
| 1,943,757 | 1/1934 | DeLaney | 156/252 |
| 1,968,246 | 7/1934 | Coleman | 156/71 |
| 4,274,901 | 6/1981 | Elber | 156/252 |
| 4,288,962 | 9/1981 | Kavanaugh | 52/746 |

FOREIGN PATENT DOCUMENTS

| | | | |
|---|---|---|---|
| 1326894 | 8/1973 | United Kingdom | 156/313 |

*Primary Examiner*—John J. Gallagher

*Attorney, Agent, or Firm*—Arnold, White & Durkee

[57] ABSTRACT

An improved method of adhering a waterproofing membrane to an underlayment and substrate is disclosed. A perforated underlayment comprising a tough, fibrous reinforcing base layer or matting impregnated with a bitumen/polymer mixture substantially similar to the bitumen/polymer mixture of the waterproofing membrane is placed on a substrate. The exposed underside of the waterproofing membrane is heated until it reaches a softening point. Thereafter, the membrane is unrolled onto the underlayment whereby the membrane and the underlayment are bonded essentially into a single ply. Additionally, when the membrane is unrolled, the bitumen/polymer mixture is sufficiently molten to flow and pass through the openings of the perforations thereby bonding the final waterproofing membrane to the substrate.

7 Claims, 3 Drawing Figures

SINGLE PLY ROOFING BASE SHEET ADHERENCE METHOD

BACKGROUND OF THE INVENTION

In the installation of single ply waterproofing membranes it is common practice to interpose an underlayment membrane between the substrate and the waterproofing membrane. This is done in order to relieve the waterproofing membrane to some extent from the direct application of strains caused by shrinkage and expansion of the substrate due to environmental and other conditions. To a certain degree, such practice also tends to smooth out surface irregularities.

According to conventional practice, the underlayment membrane is applied to the substrate with a suitable adhesive, typically roofing cement or asphalt, or with mechanical fasteners, which must be applied in a separate time consuming and labor intensive operation, since sufficient care must be taken in the application steps in order to assure that the final waterproofing membrane complies with ASTM standards for resistance to uplifting pressure forces caused most often by winds blowing over the surface of the material. Additionally, the use of adhesives has the further disadvantage of limiting the repair or installation of waterproofing membranes to periods of warmer weather which are required for the use of adhesives.

It is not uncommon for the underlayment membrane to be formed from a reinforcing mat or web base layer impregnated with a bitumen/polymer mixture the same as or similar to the mixture which comprises the primary waterproofing constituent of the waterproofing membrane itself. However, improved methods of adhering single ply waterproofing membranes to a substrate which are less labor intensive and which provide increased strength and flexibility are desired.

SUMMARY OF THE INVENTION

The waterproofing membranes contemplated for use in the present invention comprise one or more fibrous reinforcing mats or webs impregnated with bitumen which has been modified by the addition of a thermoplastic polymer or mixture of polymers such that there is formed an impregnating composition which typically has a softening point, as measured by the standard ASTM ring and ball procedure, between about 105° C. and about 155° C. The waterproofing membrane is formed by the conventional method, which involves melting the polymeric materials and thereafter adding the bitumen and blending for about one to two hours, with or without the mixture of additional bitumen and fillers. The reinforcing fibrous material is impregnated with the bitumen/polymer mixture by passing the fibrous mat or web through the bitumen/polymer mixture at temperatures above the softening point, typically about 175° C., whereby the reinforcing layer and the bitumen/polymer mixture adhere and interact with each other to form a single waterproofing membrane about 4 mm to 7 mm thick, preferably 4 mm to 5 mm, and weighing about 4.3 kg. to about 5.4 kg. per square meter. The resultant membrane is formed in such a way that the thickness between the lower surface of the membrane and the inner fibrous web is about 2.5 mm. During installation of the waterproofing membrane, the membrane is placed over a bituminous underlayment sheet which has been typically nailed, tacked, stapled, or otherwise bonded to the substrate. The underside of the waterproofing membrane is heated as the membrane is unrolled over the underlayment, thus causing the bitumen/polymer mixture to soften and flow, in turn essentially fusing to the bituminous underlayment to form a single ply membrane.

In the improved method of the present invention, the underlayment membrane is further characterized in that it is prepared with perforations, relatively uniformly dispersed across its surface area whereby during the application of the waterproofing membrane (overlayment) the heated bitumen/polymer mixture will fuse not only with the underlayment membrane but also pass through the perforations to the substrate to a sufficient degree so as to function as a suitable adhesive, bonding the final single ply waterproofing membrane to the substrate sufficiently to prevent delamination during the uplifting pressure forces exerted as winds pass over the membrane.

The exact form and relative positioning of the perforations in the underlayment membrane is not critical, except to the extent that the openings of such perforations should be relatively uniformly distributed across the underlayment membrane and should comprise only a minor portion, between about 15% to about 25%, of the entire surface area of the underlayment membrane. The perforations may be accomplished by any suitable means. The size of the perforations should be between about 10 mm and about 150 mm, with the preferred size range being from about 40 mm to about 100 mm. The optimum size will be a function of the number and distribution pattern of the perforations and the adhesion characteristics of the bitumen/polymer mixture relative to the particular substrate.

DETAILED DESCRIPTION

Figure 1:
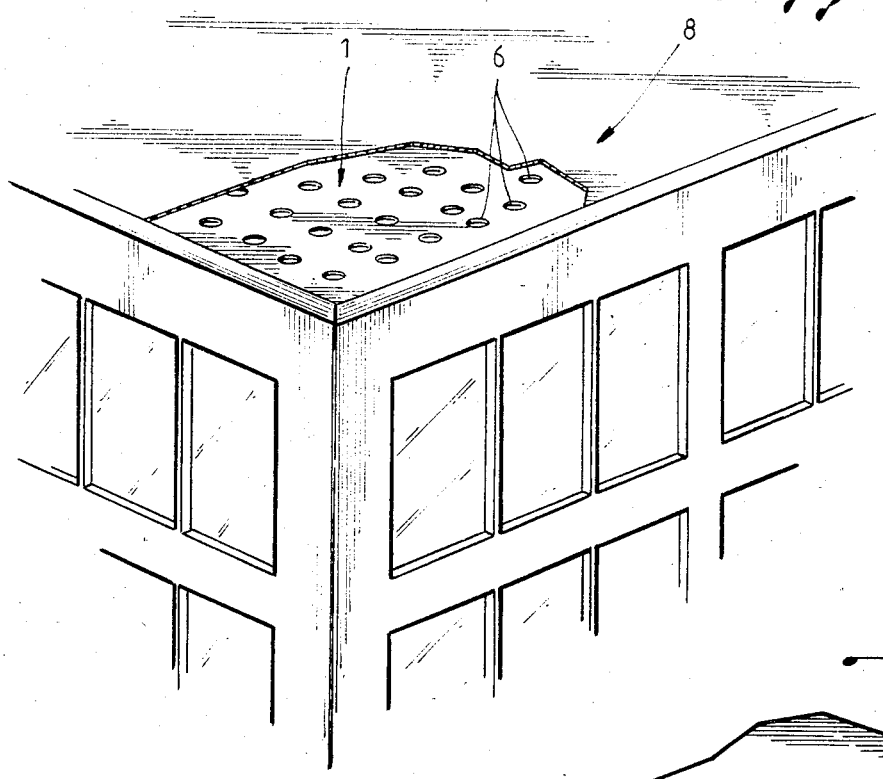
FIG. 1 is a fragmentary view of a waterproofing membrane installed over a perforated underlayment on a roof.
Figure 2:
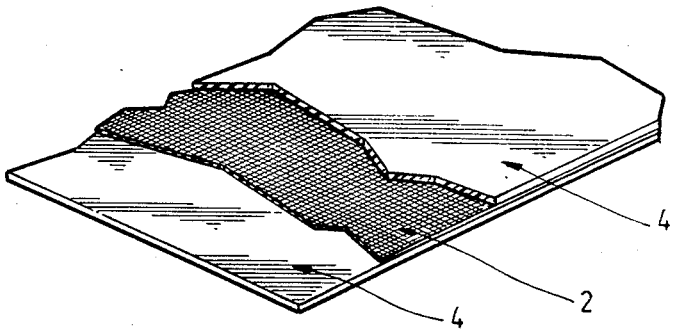
FIG. 2 illustrates the composition of the underlayment membrane.

Referring to FIG. 2 the underlayment 1 comprises a reinforcing base layer or matting 2 impregnated and coated with a bitumen/polymer mixture 4. The make-up of the underlayment is similar to the waterproofing membrane composition. The base layer can be any suitable material capable of being coated with a bituminous mixture, for example, paper, cotton, asbestos or linen fibers, or synthetic fibers such a fiberglass, polyester, or the like. In the present invention, base material of non-woven synthetic fibers are preferred since non-woven fibers will stretch and contract rather than break due to the expanding, contracting or cracking of the substrate. The bituminous mixture 4 coating the base layer will preferably be of substantially the same type of mixture used in the waterproofing membrane 8 shown in FIGS. 1 and 3. This will generally be a bitumen/polymer mixture where the polymers are primarily amorphous polymers such as atactic polypropylene along with some crystalline polymers such as isotactic polypropylene and various other copolymeus and fillers.

Figure 3:
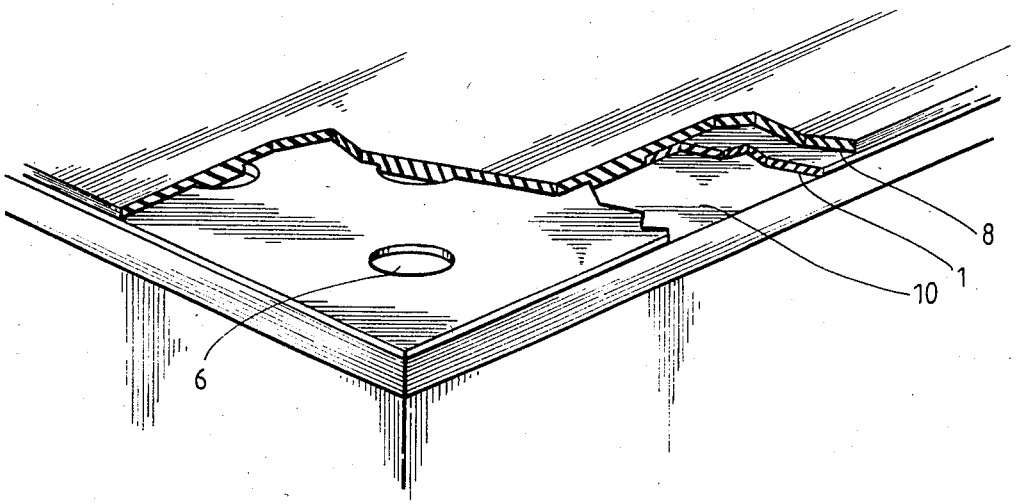
FIG. 3 is a fragmentary view illustrating in greater detail the installation of a waterproofing membrane over a perforated underlayment.

Referring to FIGS. 1 and 3, the underlayment 1 is further characterized by perforations 6 dispersed across the surface layer of the underlayment. The location of the perforations across the membrane are not critical, but uniform distribution of the holes of the perforations is preferred. Additionally, only a minor portion of the underlayment—i.e., about 15% to 25% of the total surface area of the membrane—should comprise openings. The openings themselves should have diameters of between about 10 mm and about 150 mm, and preferably in a range between 40 mm to 100 mm.

The preferred practice of the invention involves placing the underlayment 1 on a substrate or "deck" 10. The substrate to which the underlayment can be applied is any suitable substrate including but not limited to wood, concrete or metal. The underlayment will typically come in rolls, generally the same width as the waterproofing membrane to be applied, about 39 to 40 inches. The underlayment is unrolled on the substrate such that the edges of successive sections of the underlayment overlap each other. The underlayment is held in place during installation by nailing, tacking, stapling, bonding or otherwise fastening the underlayment to the substrate.

The waterproofing membrane 8 is applied to the underlayment 1 and the exposed portions of the substrate 10 through the perforations 6 by heating the exposed underside of the rolled-up membrane 8 until the exposed underside of the membrane becomes slightly molten and begins to flow, i.e., becomes tacky. The exposed underside is then unrolled onto the underlayment. A torch is typically employed to heat the exposed underside of the rolled-up waterproofing membrane. During the heating process enough heat is deflected from the underside of the membrane to cause the substantially similar bitumen/polymer mixture of the underlayment to become slightly tacky as well. Thus, when the membrane is unrolled onto the underlayment, a bond is formed between the membrane and the underlayment such that an essentially single ply membrane results. In addition, the heating is sufficient to cause the bitumen/polymer mixture on the underside of the membrane to flow or pass through the perforations 6 to the exposed substrate, thereby bonding the final waterproofing membrane to the substrate. The resulting multiplicity of bonds between the waterproofing membrane and the substrate provide sufficient strength to prevent delamination during the uplifting pressure forces exerted as wind passes over the membrane as well as allowing the substrate to expand and contract while minimizing the strain transmitted to the membrane.

It is, of course, recognized that the above description is for the purposes of illustrating in detail one method of practicing the present invention. Other variations and modifications of the present invention will be readily recognized by those skilled in the art. It is the intention of the inventor that all such modifications and variations be encompassed in the scope of the present invention.

What is claimed is:

1. A method of waterproofing a roofing substrate comprising:

(a) covering a substrate with a perforated underlayment comprising a reinforcing fibrous material impregnated with a bitumen/polymer mixture, said perforations being about 10 mm to about 150 mm in diameter, and the composite cross-sectioned area of said perforations comprising no greater than about 25% of the total surface area of one side of the underlayment membrane;

(b) heating the underside of a waterproofing overlayment membrane which comprises a reinforcing fibrous material impregnated with a substantially similar bitumen/polymer mixture as said bitumen/-polymer mixture of said underlayment membrane, said heating being sufficient to cause said bitumen/-polymer mixture to exceed its softening point and begin to flow; and (c) covering said underlayment membrane with said overlayment waterproofing membrane soon enough after heating to cause in part said bitumen/-polymer mixture of said overlayment to fuse to said bitumen/polymer mixture of said underlayment and in part to allow said bitumen/polymer mixture of said overlayment to pass through said perforations and adhere to said substrate.

2. The method of claim 1 wherein said perforations are about 40 mm to about 100 mm in diameter.

3. The method of claim 2 wherein said bitumen/-polymer mixture has a standard ASTM ring and ball softening point of about 105° C. to about 155° C.

4. The method of claim 2 wherein said reinforcing fibrous material of said underlayment is non-woven polyester.

5. The method of claim 2 wherein said overlayment membrane is about 4 mm to about 7 mm thick, weighs about 4.3 kg to about 5.4 kg per square meter, and has a layer of bitumen/polymer mixture on its underside at least 2 mm thick.

6. The method of claim 2 wherein said underlayment is no thicker than about 2.5 mm.

7. In the method of installing a waterproofing membrane over a relatively flat substrate wherein a single ply overlayment waterproofing membrane having an underside consisting essentially of a bitumen/polymer mixture at least 2 mm in thickness and having a ring and ball softening point between about 105° to about 150° C. is placed over a relatively thin single ply underlayment membrane which has been suitably adhered to the surface to be waterproofed, said underlayment membrane being further characterized in that it is no thicker than about 2.5 mm and consists of a non-woven fibrous mat substantially saturated with essentially the same bitumen/polymer mixture as said overlayment membrane, and heating the underside of said overlayment membrane as it is being placed over the underlayment membrane such that the bitumen/polymer mixture in the waterproofing membrane reaches a point sufficiently above its flow temperature that the overlayment and underlayment membranes fuse together to form essentially a single layer membrane, the improvement wherein said underlayment membrane is further characterized by perforations relatively uniformly dispersed across its surface area, ranging in size from about 10 mm to about 150 mm, and constituting no more than about 15 to about 25% of the total surface area of the underlayment, whereby during the placing of the overlayment membrane onto the perforated underlayment, the heated bitumen/polymer mixture flows through said perforations to the substrate to a sufficient degree so as to adequately maintain the final waterproofing membrane on the substrate under existing environmental conditions without the need for additional adhesive or treating steps.

* * * * *